US007225863B2

(12) United States Patent
Anastasijevic et al.

(10) Patent No.: US 7,225,863 B2
(45) Date of Patent: Jun. 5, 2007

(54) PLATE-TYPE HEAT EXCHANGER WITH ANODIC CORROSION PROTECTION

(75) Inventors: Nikola Anastasijevic, Altenstadt (DE); Karl-Heinz Daum, Wiesbaden (DE); Wolfram Schalk, Neu-Anspach (DE); Stefan Laibach, Geismar/Rhön (DE)

(73) Assignee: Outokumpu Oyj, Espoo (FI)

( * ) Notice: Subject to any disclaimer, the term of this patent is extended or adjusted under 35 U.S.C. 154(b) by 311 days.

(21) Appl. No.: 10/480,752

(22) PCT Filed: May 28, 2002

(86) PCT No.: PCT/EP02/05843

§ 371 (c)(1),
(2), (4) Date: Jul. 1, 2004

(87) PCT Pub. No.: WO02/101314

PCT Pub. Date: Dec. 19, 2002

(65) Prior Publication Data

US 2004/0251005 A1 Dec. 16, 2004

(30) Foreign Application Priority Data

Jun. 13, 2001 (DE) ..... 101 28 774

(51) Int. Cl.
*F23F 19/00* (2006.01)
*C23F 13/00* (2006.01)

(52) U.S. Cl. ..... 165/134.1; 204/196.1

(58) Field of Classification Search ..... 165/134.1; 104/196.01
See application file for complete search history.

(56) References Cited

U.S. PATENT DOCUMENTS

| | | | | |
|---|---|---|---|---|
| 4,196,064 | A * | 4/1980 | Harms et al. | 205/735 |
| 4,586,562 | A * | 5/1986 | Carlson et al. | 165/134.1 |
| 4,588,022 | A * | 5/1986 | Sanz | 165/134.1 |
| 4,800,007 | A * | 1/1989 | Karlsson et al. | 204/196.02 |
| 5,346,598 | A * | 9/1994 | Riffe et al. | 422/6 |
| 5,513,694 | A * | 5/1996 | Cameron | 165/134.1 |
| 5,515,913 | A * | 5/1996 | Sanz | 204/196.02 |
| 5,643,424 | A * | 7/1997 | Riffe et al. | 204/196.05 |
| 5,910,236 | A * | 6/1999 | Iossel et al. | 204/280 |
| 6,357,516 | B1 * | 3/2002 | Judge et al. | 165/96 |

FOREIGN PATENT DOCUMENTS

| | | |
|---|---|---|
| DE | 2 244 331 | 3/1974 |
| WO | 86/01837 | 3/1986 |

* cited by examiner

*Primary Examiner*—Allen J. Flanigan
(74) *Attorney, Agent, or Firm*—Morgan & Finnegan, LLP

(57) ABSTRACT

To protect a plate-type heat exchanger (1) against corrosion due to the attack of sulfuric acid, it is proposed in accordance with the invention that the region through which flows sulfuric acid has at least one metal cathode (16, 17) and one reference electrode (27), that at least half the metal plates (7) have an electric contact (23) which is connected with the anode (21) of an electric d.c. voltage source of variable electric voltage, that the metal cathode (16, 17) likewise is electrically connected with the d.c. voltage source, and that the d.c. voltage source belongs to a potentiostat (20) which is electrically connected with the reference electrode (27).

5 Claims, 1 Drawing Sheet

PLATE-TYPE HEAT EXCHANGER WITH ANODIC CORROSION PROTECTION

DESCRIPTION

Figure 1:
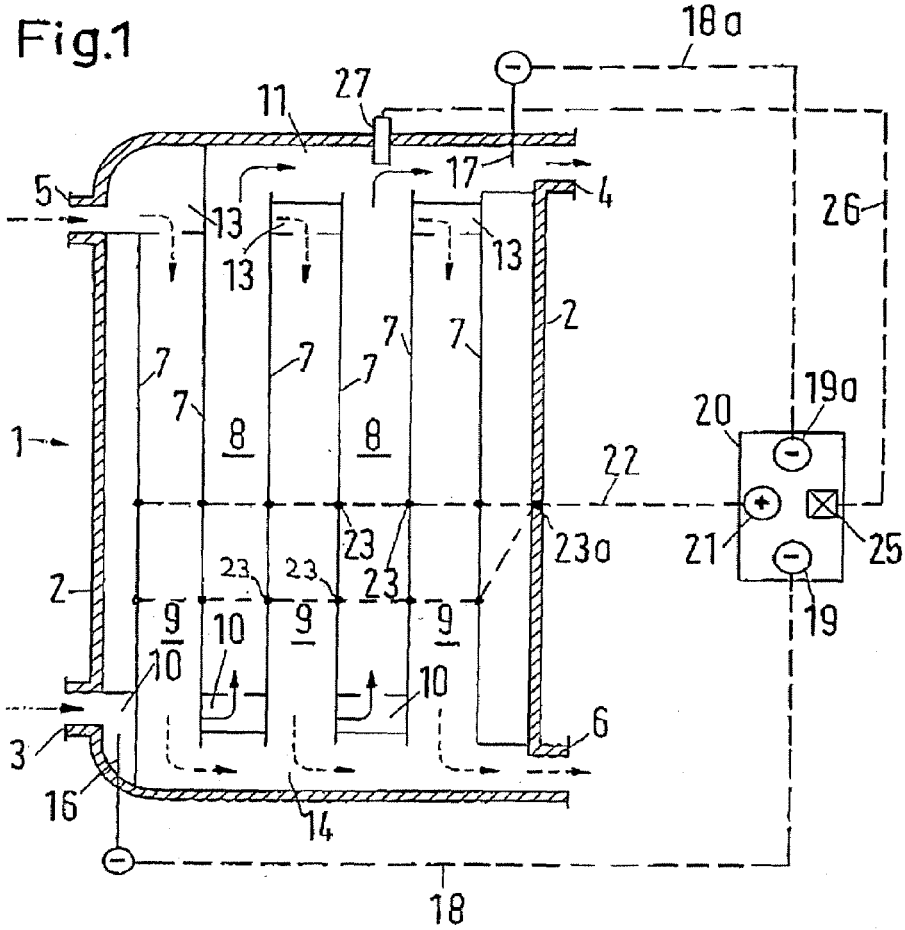

This invention relates to a plate-type heat exchanger comprising numerous parallel metal plates, between which there are alternately formed permeable cold chambers for cooling liquid and permeable hot chambers for the hot liquid to be cooled, comprising a housing surrounding the plates, which housing has supply lines and discharge lines for the liquids, comprising a first distribution passage for supplying the hot liquid to the hot chambers, comprising a second distribution passage for supplying the cooling liquid to the cold chambers, and comprising a first collecting passage for discharging the hot, cooled liquid and a second collecting passage for discharging the cooling liquid.

It is the object underlying the invention to protect such plate-type heat exchanger against corrosion due to the attack of sulfuric acid. In accordance with the invention, this is achieved in that the metal plates and the housing are designed for the passage of sulfuric acid as hot liquid and for the passage of water as cooling liquid, that the region through which flows sulfuric acid has at least one metal cathode and one reference electrode, that at least half the metal plates have an electric contact which is connected with the anode of a d.c. voltage source of variable electric voltage, that the metal cathode likewise is electrically connected with the d.c. voltage source, and that the d.c. voltage source belongs to a potentiostat which is electrically connected with the reference electrode.

Expediently, a metal cathode is disposed in the first distribution passage and/or in the first collecting passage, where it gets in direct contact with the sulfuric acid. In particular in the case of large-surface metal plates it may be expedient to pass a metal cathode through a plurality of hot chambers, which metal cathode is sealed against the metal plates and electrically insulated. There is thus obtained contact with the sulfuric acid flowing in the chambers.

The anodically protected metal plates, which are equipped with associated electric contacts, can for instance also have 2 to 5 electric contacts per plate, when the plates should rather uniformly be protected against corrosion in all regions. The housing can also have one or more electric contacts which are connected with the variable d.c. voltage source, in order to achieve an anodic protection. Expediently, all metal plates will be protected anodically. By means of the anodic protection, a metal oxide layer is produced on the side against which flows the sulfuric acid, which metal oxide layer prevents the corrosion attack.

The plate-type heat exchanger protected against corrosion in accordance with the invention can be used for instance in plants for producing sulfuric acid, in which sulfuric acid with a $H_2SO_4$ content in the range from 90 to 100 wt-% and temperatures in the range from 140° C. to the boiling point must be cooled by indirect heat exchange. The plates may be made of alloyed steel which apart from iron in particular has the alloying components chromium, nickel and molybdenum.

Figure 2:
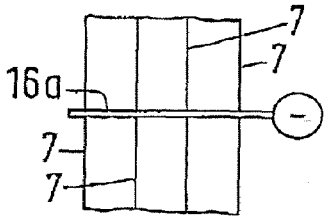
Figure 3:
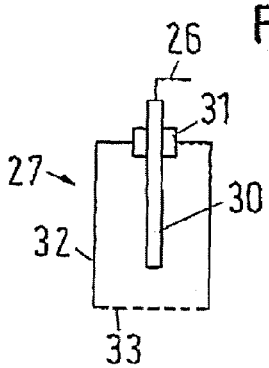

Embodiments of the plate-type heat exchanger will be explained with reference to the drawing, in which:

FIG. 1 shows a section through the plate-type heat exchanger in a schematic representation, FIG. 2 shows a variant of the arrangement of a metal cathode, and FIG. 3 shows a reference electrode in a longitudinal section in a schematic representation.

The plate-type heat exchanger (1) of FIG. 1 has a housing (2) comprising a supply line (3) and a discharge line (4) for the hot sulfuric acid to be cooled as well as a supply line (5) and a discharge line (6) for the cooling water. In the housing (2), parallel metal plates (7) are provided, between which there are disposed hot chambers (8) for the passage of sulfuric acid to be cooled and cold chambers (8) for the passage of cooling water. The acid enters through the supply line (3) and first of all gets into a first distribution passage (10), from where it flows through the hot chambers (8) to a first collecting line (11) and leaves the exchanger (1) through the discharge line (4). The cooling water enters the exchanger (1) through the supply line (5) and is supplied by the second distribution passage (13) to the cold chambers (9), reaches the second collecting passage (4) and then the discharge line (6).

A first metal cathode (16) is provided in the first distribution passage (10), and the insulated metal cathode extends through the housing (2). Analogously, a second metal cathode (17) is provided in the first collecting passage (11). During the operation of the exchanger (1), both cathodes (16) and (17) are in contact with the sulfuric acid, whose corrosion attack must be stopped. In the vicinity of the contact with the sulfuric acid, the cathodes are made of stainless steel, for instance, which has a high resistance to hydrogen embrittlement, and outside the housing (2) they are connected with the negative poles (19) and (19*a*) of a potentiostat (20) by electric lines (18) or (18*a*). In a manner known per se, the potentiostat has a variable d.c. voltage source, whose positive pole (21) is connected with the electric contacts (23) of the metal plates (7) to be protected via the electric line (22). The housing (2) also has an electric contact (23*a*), in order to obtain an anodic corrosion protection. Each of the plates (7) to be protected can have a plurality of electric contacts (23) connected with the positive pole (21), e.g. 2 to 5 electric contacts per plate. Mostly, it is expedient to dispose the contacts (23) at the edges of the plates, in order to achieve a constructionally simple realization of the anodic protection.

The potentiostat (20) has a connection (25) for an electric line (26) which leads to a reference electrode (27). This reference electrode (27) provides the measurement basis for the potentiostat (20), and in a manner known per se it may constitute e.g. a calomel electrode, a $Hg/Hg_2SO_4$ electrode, or a cadmium bar as shown in FIG. 3. Surrounded by an electric insulation (31), the cadmium bar (30) is provided in a housing (32) which has a diaphragm (33). This diaphragm is permeable for the sulfuric acid, so that the cadmium bar (30) is constantly immersed in the sulfuric acid flowing past the same. The potential developed thereby is supplied to the potentiostat (20) by the electric line (26).

In the case of large metal plates the anodic protection in the middle region of the plate surface can possibly be smaller than in the vicinity of the plate edge. To provide sufficient anode current for the desired corrosion protection in this case as well, it may be expedient to pass a metal cathode through the middle region of the plates (7), as is schematically represented by means of FIG. 2. The cathode constitutes a metal bar (16*a*), and the sealed and electrically insulated cathode extends through the plates (7). In this way, the anode current necessary in the plate region susceptible to corrosion can precisely be determined.

The invention claimed is:

1. A plate-type heat exchanger comprising numerous parallel metal plates, between which there are alternatively formed permeable cold chambers for cooling liquid and permeable hot chambers for the hot liquid to be cooled, a housing surrounding the plates, which housing has supply lines and discharge lines for the liquids, a first distribution passage for supplying the hot liquid to the hot chambers, a second distribution passage for supplying the cooling liquid to the cold chambers, and a first collecting passage for discharging the hot, cooled liquid and a second collecting passage for discharging the cooling liquid, the metal plates and the housing being designed for the passage of sulfuric acid as hot liquid and for the passage of water as cooling liquid, the region through which flows sulfuric acid having at least one metal cathode and one reference electrode, at least half the metal plates having a plurality of electric contacts connected with the anode of a d.c. voltage source of variable electric voltage, the metal cathode likewise being electrically connected with the d.c. voltage source, and the d.c. voltage source belonging to a potentiostat which is electrically connected with the reference electrode.

2. The plate-type heat exchanger as claimed in claim 1, wherein a metal cathode is disposed in the first distribution passage.

3. The plate-type heat exchanger as claimed in claim 1, wherein a metal cathode is disposed in the first collecting passage.

4. The plate-type heat exchanger as claimed in claim 1, wherein a metal cathode extends through a plurality of hot chambers, which metal cathode is sealed against the metal plates and electrically insulated.

5. The plate-type heat exchanger as claimed in claim 1, wherein a plurality of metal plates have 2 to 5 electric contacts per plate.

* * * * *